US006540148B1

(12) United States Patent
Salsbury et al.

(10) Patent No.: US 6,540,148 B1
(45) Date of Patent: Apr. 1, 2003

(54) METHOD AND APPARATUS FOR SEQUENCING MULTISTAGE SYSTEMS OF KNOWN RELATIVE CAPACITIES

(75) Inventors: Timothy I. Salsbury, Milwaukee, WI (US); Bin Chen, St. Francis, WI (US)

(73) Assignee: Johnson Controls Technology Company, Plymouth, MI (US)

( * ) Notice: Subject to any disclaimer, the term of this patent is extended or adjusted under 35 U.S.C. 154(b) by 0 days.

(21) Appl. No.: 09/917,005

(22) Filed: Jul. 27, 2001

(51) Int. Cl.[7] ..... F23N 23/00; F25B 7/00

(52) U.S. Cl. ..... 236/1 EA; 62/175; 165/256; 307/39; 417/17

(58) Field of Search ..... 62/158, 175, 117; 236/1 EA; 165/256; 307/39; 417/17

(56) References Cited

U.S. PATENT DOCUMENTS 4,384,462 A * 5/1983 Overman et al. ..... 62/175
4,903,502 A * 2/1990 Hanson et al. ..... 62/228.5
6,185,946 B1 * 2/2001 Hartman ..... 236/1 EA
6,233,954 B1 * 5/2001 Mehaffey ..... 236/1 EA X

* cited by examiner

*Primary Examiner*—William Wayner
(74) *Attorney, Agent, or Firm*—Foley & Lardner

(57) ABSTRACT

Disclosed is a method and apparatus for controlling multistage systems where the relative capacities (process gains) of each stage are known. The method uses a split-range control concept in order to control multiple stages with a single feedback controller, such as PID. Stage combinations are generated automatically and sequenced to provide contiguous control and optimum control resolution across the overall range of the multistage system. The control method incorporates hysteretic deadzones to improve robustness around stage transition points. The assumption of a tuned PI feedback controller allows the size of the deadzone to be related to general control performance requirements applicable across classes of similar systems. A simulated HVAC&R system is used to evaluate the method and it is compared an alternative approach.

21 Claims, 8 Drawing Sheets

METHOD AND APPARATUS FOR SEQUENCING MULTISTAGE SYSTEMS OF KNOWN RELATIVE CAPACITIES

BACKGROUND

The present invention relates to methods and apparatuses for controlling multistage systems, and particularly to methods and apparatuses for controlling multistage systems in HVAC&R applications.

A multistage system comprises a plurality of subsystems with each subsystem contributing something to overall performance. Examples of multistage systems found in the heating, ventilating, air-conditioning, and refrigeration (HVAC&R) industry are: commercial refrigeration units used for food storage, rooftop DX cooling systems, and building chiller systems. Typical multi-stage systems can be divided into two types: systems which include one or more stage capable of being modulated or operated in an analog fashion, e.g., by using variable speed drives (VSD) on compressors, and digital systems wherein all stages are limited to either being on or off. In both types of systems, the stages may have equal or unequal capacities.

Typical control systems for controlling HVAC&R systems receive a command from a user selected input at, for example, a thermometer, and feedback from inside a room or compartment under control indicating the actual temperature therein. Based on this input, a controller activates a number of stages or devices to move from the actual temperature to the selected temperature.

In the simplest case, where all stages are of the same capacity, a prior art controller would activate or deactivate new stages one-by-one as the load increases or decreases. In situations where each stage or device has a different capacity, improved control resolution can be obtained by devising a table of different stage combinations. Each stage combination would represent various digital on/off states for individual devices, where application of each stage combination would produce a particular total output capacity from the multistage system. The table would contain these various combinations ordered according to deliverable capacity. In prior art methods, stage combination tables are created manually and the controller changes between combinations by working sequentially up or down the table depending on whether load is increasing or decreasing. Stage combination tables are established based on the number of stages in a system and the capacity of each stage, and are therefore specific to a selected system. The stage combination tables are stored in the memory of the controller for retrieval during operation of the control device. In applications that include stages that can be modulated to provide intermediate capacity levels, information related to the modulation capabilities of these stages can also be stored.

To avoid instability at transition points between stage combinations, prior art controllers typically employ timer delays and/or deadbands. Timer delays and/or deadbands are employed to verify that a change in an input signal corresponds to an actual requested change, and therefore to filter out changes due to noise or other external factors which may have caused a temporary change in the measured signal.

In an all-digital system, a deadband is defined around setpoint and a change in a stage combination is invoked only when the measured signal is maintained outside of the deadband for a sustained period, as determined by the delay timers. A different combination of stages corresponding to a higher or lower capacity is activated according to whether the deadband is exceeded at its upper or lower limit, moving sequentially through all intermediate stage as noted above. In an all-digital system, load points that are between defined stage combinations can only be reached by quickly moving between the straddling stage combinations.

In a system including individual stages capable of being modulated such as an air-handling unit with sequenced heating, cooling, and heat-recovery, a feedback controller can be used to modulate the output of one particular stage until the controller saturates high or low (see "A New Sequencing Control Strategy for Air-andling Units", Seem, J. E. et al., *International Journal of Heating, Ventilating, Air-conditioning, and Refrigeration Research*, Volume 5, Number 1, January 1999, pp. 35–38). A time delay is then applied so that a new stage combination is only invoked when the controller has been saturated for a sustained period. When a new combination is activated, the feedback controller switches so that it controls another device leaving the previous device in its saturated state, either fully on or fully off. Sometimes, a deadband is also incorporated so that a change in stage combination is only made when the setpoint error is large enough to exceed the deadband. This prevents changes in stage combinations when the controller has saturated but there is little or no demand for capacity change. As in the digital control method described above, control performance is determined by the time delay and the magnitude of any deadbands that are used.

While the typical prior art systems described above are generally useful in controlling a multistage system, there are significant problems associated with each of these systems. First, as noted above, typical control systems require the establishment of manual stage combination tables, which are generated for a specific application. The associated controller is therefore tied to a specific application, and changes to the controller are generally required when changes are made to the controlled stages, when new stages are added, or when stages are removed. Secondly, the deadzone and time delay methods employed in typical prior art systems produce significant time delays and sluggish control response, particularly when significant changes. in capacity are requested. Faced with a large change in demand, a conventional controller designed around deadbands and timers must wait for the designated delay time at each intermediate stage combination before being able to move to the next. For large disturbances, such as start-up transients, there would therefore be a compounded delay time that would make the control sluggish. These problems are compounded by the fact that prior art controllers typically step sequentially through all stages, delaying at each one before reaching at suitable stage combination corresponding to the requested setpoint. Additionally, prior art controllers also require selection of a transition time delay, which is difficult to relate to any measure of control performance. Having a fixed time delay also means that the control methods will be equally as sensitive to large and small setpoint errors. This is counter-intuitive as a more rapid response and hence small delay is desirable for large errors, while a longer delay may be tolerable for smaller errors.

U.S. Pat. No. 5,440,891 to Hindmon proposes an alternative prior art controller based on a fuzzy logic algorithm. Here, the fuzzy logic controller determines an appropriate combination of stages to activate based on the measured controlled variable. The controller is capable of moving to a new stage combination without having to pass through intermediate stages. The delay in moving between different stage combinations is also variable allowing rapid reaction to large disturbances. While responding to certain deficiencies in the prior art, however, there are also problems associated with the fuzzy logic approach. Specifically, in a fuzzy logic system, the performance of the controller is determined by a predetermined set of fuzzy rules and other internal parameters, and is therefore specifically tuned for a given application. Variable levels of control performance are obtained when the method is applied to different systems. Re-configuration or tuning for a specific application can be difficult, time consuming, and inefficient, and could require an entire recreation of the fuzzy rule set.

SUMMARY OF THE INVENTION

The present invention is a control method and apparatus for use with or in multistage systems that is particularly suited for use in the HVAC&R industry, such as in the aforementioned examples of food storage refrigeration systems, rooftop DX cooling units, and building chiller systems.

The control method of the present invention combines a table of stage combinations with a hysteretic deadzone and a split range control method to produce a new control method that can be applied to a general multistage control system where the capacities (gains) of the stages are known a priori. The present invention further automates the generation of stage combination tables to provide a flexible control system which can be easily modified. Unlike, prior art methods the present invention can produce consistent control performance across classes of similar systems without the need to tune each particular implementation.

In one aspect of the invention, combinations of stage states (hereafter referred to as "stage combinations") in which selected stages are either fully on or fully off are automatically generated and ordered according to deliverable capacity. At least one stage in each stage combination is left inactive such that this stage can be individually controlled by means of pulsing or modulation to provide contiguous control between the discrete outputs available (in steady-state) at the different on/off stage combinations. Data necessary for constructing stage combinations including the number, relative capacity, and type of stages in the system are provided by a user, and are therefore individualized for each system to which a controller constructed in accordance with the present invention is used. The automatic construction of stage combinations obviates the need for manual tables of stage combinations, and allows a controller constructed in accordance with the present invention to be used in conjunction with or moved between different multistage systems.

In another aspect of the invention, stage combination tables are employed to provide a selected capacity output based on a main control signal, which provides an operational setpoint. The main control signal is used to determine a minimum capacity of the stage combination closest to, but greater than or less than the selected setpoint, depending on whether the command is increasing or decreasing. The main control signal is also used to calculate a "split range" signal corresponding to the amount of capacity that must be provided by the individually-controlled stage in the stage combination. Hysteretic deadzones are centered on the points where transitions occur between stage combinations. The deadzones define a region around each stage combination transition point in which a change in stage combination is not allowed. In these deadzone regions, the split range control is saturated to maintain the individually controlled stage at its minimum or maximum value, depending on whether demand is decreasing (i.e., moving to a lower capacity stage) or increasing (moving to a higher capacity stage), and is maintained in this state until the main control signal exceeds the deadzone. After the deadzone is exceeded, the next stage combination to be activated is selected based on the magnitude of the main control signal. The control does not "step through" or automatically switch to the next higher or lower capacity stage combination as is typical in prior art devices, but can select any available stage combinations depending on the magnitude of the setpoint.

The method and apparatus of the present invention therefore provides a number of notable advantages over typical prior art devices. First, in the present invention, stage combination tables that provide for a contiguous control range can be automatically generated and revised when new or different stages are added to a system. These systems can be easily controlled by a network or other communications system, and changes in the multistage system can be easily implemented without changes to hardware configurations. Additionally, through the use of hysteretic deadzones in combination with a split range control method, the control system of the present invention reduces instability new stage transition points. Furthermore, the control method,of the present invention provides a relatively quick response time to disturbances, and particularly to large disturbances in setpoint, since the present invention allows for a "jump" to a non-sequential stage in the stage combination table, thereby allowing for significant changes in output capacity relatively quickly.

These and other objects, advantages and aspects of the invention will become apparent from the following description. In the description, reference is made to the accompanying drawings which form a part hereof, and in which there is shown a preferred embodiment of the invention. Such embodiment does not necessarily represent the full scope of the invention and reference is made therefore, to the claims herein for interpreting the scope of the invention.

DETAILED DESCRIPTION OF A PREFERRED EMBODIMENT

Figure 1:
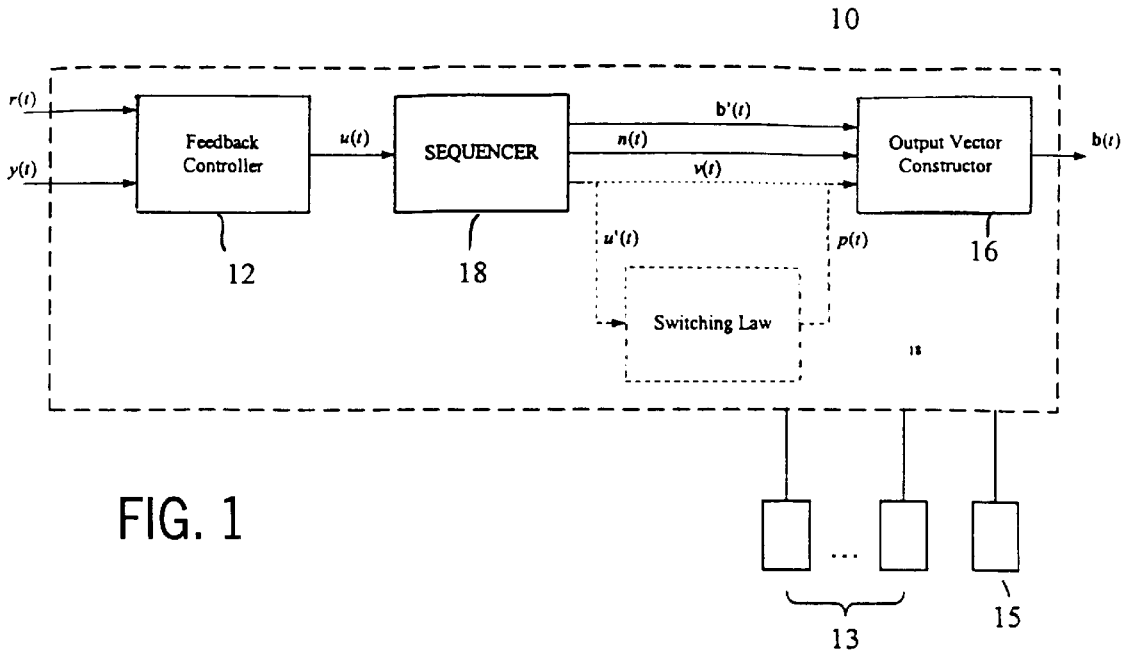
FIG. 1 is a block diagram of a multistage controller constructed in accordance with the present invention.

Referring now to the Figures, and more particularly to FIG. 1, a block diagram of a multistage controller 10 employing sequencer 18 constructed in accordance with of the present invention is shown. The controller 10 can comprise any of a number of programmable controllers including microprocessors, microcontrollers, programmable logic controllers and other devices known to those of skill in the art.

In general, the controller 10 is coupled to a plurality of stages 13. The plurality of stages 13 can include digital devices that are capable of being turned either fully on or fully off, and must include at least one stage 15 that can be controlled individually by means of pulsing or modulation. The individually controlled stage 15 can be an analog device, or a digital device driven by a switching method such as pulse width modulation (PWM) or other methods known to those of skill in the art. Typical stages for use in an HVAC&R application include on/off devices such as two position valves or actuators. Modulatable devices can include variable speed drives on compressors or fans modulating valves and actuators and other devices.

The sequencer 18 is programmed to determine appropriate stage combinations and arrange these in order of increasing capacity. Each stage combination is determined to include at least one inactive stage, which is designated for individual control by pulsing or modulation. The controller 10 receives a control signal (hereof referred to as the "main control signal") from the feedback controller 12, which provides an indication of demand (between 0 and 100%). The sequencer 18 selects an appropriate stage combination for the given main control signal value and determines a "split range control signal", which is used to control the designated individually controlled stage. The main control signal is mapped onto the range of discrete capacities represented by the various possible stage combinations causing there to be points in the main control signal range that correspond to points where a change in stage combination is made. When the main control signal approaches one of these "transition points" the sequencer 18 maintains the split range control signal at its maximum or minimum value throughout a deadzone region. When the main control signal exceeds the deadzone, the sequencer 18 selects a new stage combination, and recalculates the split range control signal. All of these steps will be described with respect to a specific embodiment below.

Referring still to FIG. 1, one embodiment of a controller 10 constructed in accordance with the present invention is shown. In this embodiment, the controller 10 is divided into four functional blocks: a feedback controller 12, a switching law block 14, an output vector constructor 16, and the sequencer 18. Each of these blocks will be described more fully below.

The controller 12 is a feedback controller that can provide any type of feedback control law known to those of ordinary skill in the art. Typically, for use in the HVAC&R industry, the controller 12 provides a proportional, integral, and derivative action controller (PID), or a PI control in which the derivative action is disabled. This controller 12 generates a main control signal u(t) between 0 and 100% based on the difference between feedback from a controlled variable y(t) and a predetermined command setpoint r(t).

The switching law block 14 is an optional block that can be used in fully digital systems, wherein individual stages must be pulsed to provide intermittent output capacity. The switching law block 14 applies a duty-cycle on a selected stage as determined by a split range control signal v(t) produced by the sequencer 18. The switching law block 14 can employ pulse-width modulation (PWM), or other switching methods known to those of ordinary skill in the art, to produce the (binary) signal p(t) for pulsing a selected stage or device.

The output vector constructor 16 creates a vector of outputs in a form that can be mapped onto the physical inputs to the stages of the multistage system in the form, for example, of digital logic-level signals or analog signals for activating, deactivating and modulating stages. The output vector constructor 16 creates the output vector b(t) from an input vector b'(t), which is output by the sequencer block 18 and comprises a combination of on or off stage states. The output vector constructor 16 constructs an output vector providing an "ON" signal to each stage expected to be fully on an "OFF" signal to such stage expected to be fully off, and a split range signal to an individually controlled stage represented hereafter as n(t). The split range signal can be applied in one of two ways. For an analog system, the output vector constructor applies the analog (i.e., between 0 and 100%) split range signal v(t) to the individually controlled stage that has the capability to be modulated. For a digital system, the output vector constructor 16 applies a digital (i.e., either 0 or 100%) output p(t) such as that generated by the switching law block 14 to a selected stage. The stage to be individually controlled by pulsing or modulation is determined by the sequencer 18, and, as noted above, can be represented as an integer number n(t).

Figure 2:
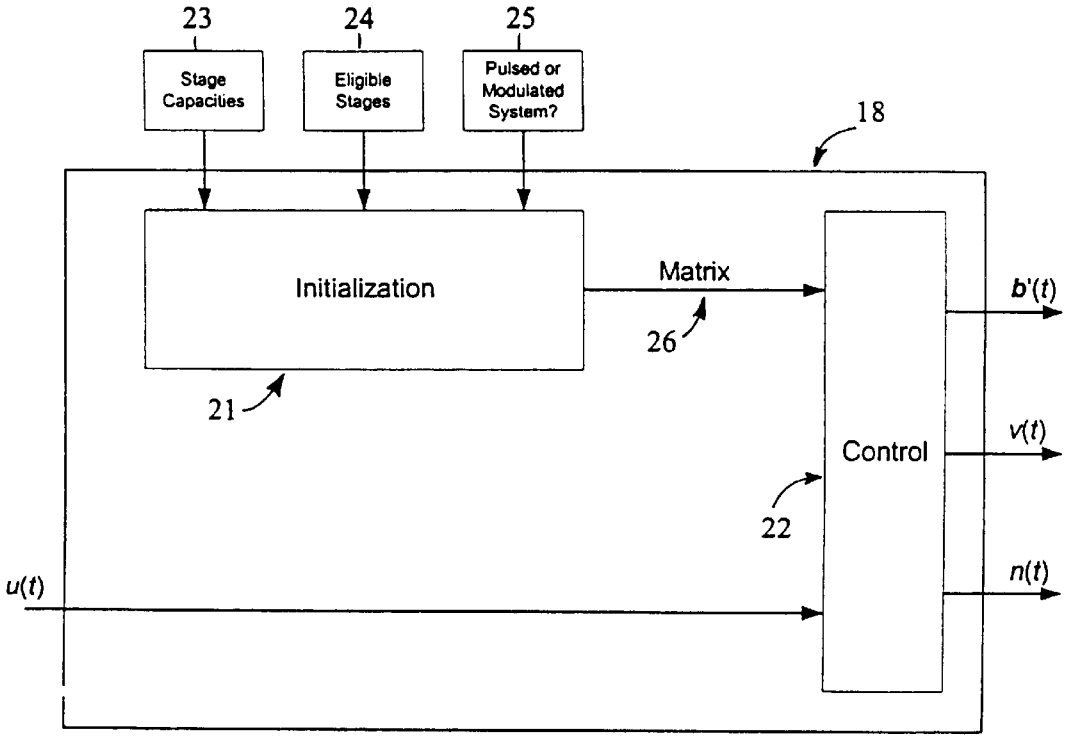
FIG. 2 is a block diagram of the sequencer of FIG. 1.

Referring now to FIGS. 1 and 2, the sequencer block 18 performs two basic functions: initialization 21 via determination of the stage combinations for a given application, and real-time-control 22 of the multistage system. During initialization 21, to determine the stage combinations, the sequencer 18 receives data related to the system including a vector containing the capacities of each stage 23, an indicator of whether the system is wholly digital having only on/off stages or whether it has stages that can be modulated 24, and information pertaining to designation of a subset of stages that are eligible for individual control via pulsing or modulation 25. Note that the vector containing the stage capacities implicitly identifies the total number of stages for a given system by virtue of its size. Based on these input data, the sequencer 18 generates a number of stage combinations in the form of a matrix 26 ordered according to capacity, with one stage n(t) in each stage combination identified as being for individual control via pulsing or modulating. During real-time control, the sequencer 18 selects a stage combination to be activated from the matrix 26 based on a main control signal u(t), calculates a split range control signal v(t), and identifies the stage number for individual control n(t). The initialization 21 and real-time 22 control functions of the sequencer 18 are described more fully below.

Referring again to FIG. 2, the general steps of the initialization stage 21 for generating an ordered matrix of stage combinations 26, are shown. For any given plurality of devices or stages, combinations of stages can be turned fully off or fully on to provide varying deliverable capacities, from a minimum capacity when all stages are off to a maximum value when, all stages are on. Intermittent steps are provided by turning on or off various different combinations of stages. To provide an output capacity between intermittent steps, at least one stage must be pulsed or modulated while holding particular combinations of on and off states for the other devices. To provide deliverable capacities between the minimum and maximum deliverable values, the sequencer block 18 determines the available stage combinations and relates these combinations to deliverable system capacity. A preferred method for determining and storing this information is to generate a table (matrix) of stage combination vectors (rows in the matrix) that is ordered according to capacity is described below.

Figure 3:
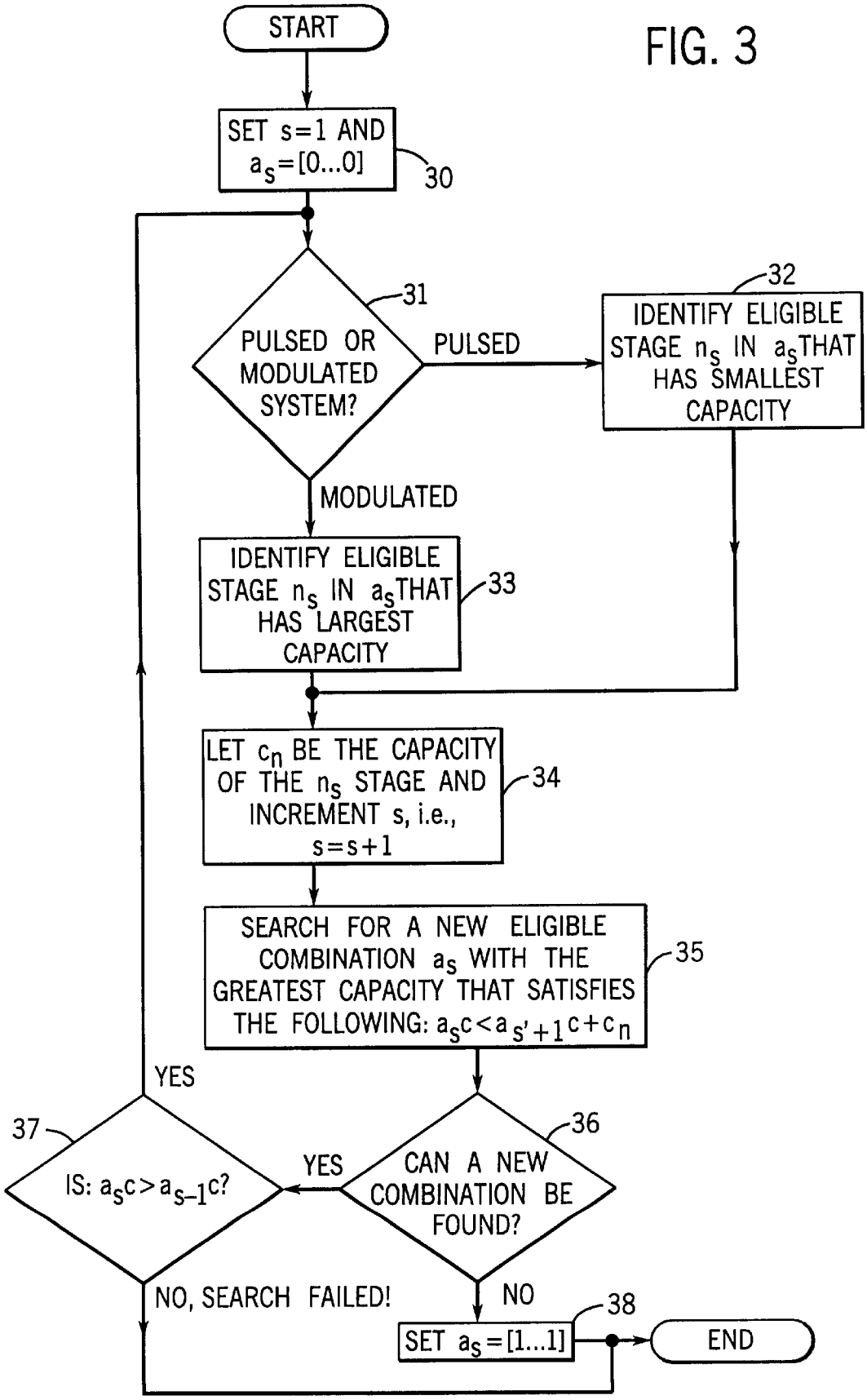
FIG. 3 is a flow chart illustrating the initialization process of FIG. 2

Referring to FIGS. 2 and 3, in order to create appropriate stage combinations, stage data including the capacities of the individual stages 23, a vector identifying the subset of stages eligible for individual control via pulsing or modulating 25, and an indicator of whether the eligible stages can be pulsed or modulated 24, must be supplied to the sequencer 18. These data are preferably provided by a user, though an input device such as a keyboard or mouse coupled to the controller 10, or though a pre-existing file which can be downloaded to the controller by means of a modem, disk drive, or other known means of transmitting data. In applications in which the system is fixed, these data can be stored in memory and retrieved as required. The number of devices and their relative capacities can be encapsulated by the sequencer 18 in the form of a stage size vector 23 (c) or array, which identifies the capacities of each stage. For example, if the stages of a refrigeration system include three compressors that had sizes of 5 kW, 10 kW, and 15 kW, the stage size vector 23 would be defined as:

$$c^T = [5 \quad 10 \quad 15]$$

In the general case, the stage size vector 23 is defined as:

$$c = \begin{bmatrix} c_1 \\ \vdots \\ c_N \end{bmatrix}$$

Where $C \epsilon \Re^N$ and N is the total number of stages. The stage size vector 23 (c) can be stored in a memory component of the controller 10 in the form of an array or other known data structure. Other user-supplied information are the indicator 24 identifying whether the system is a pulsed or modulated system and the identification of a subset of stages that are eligible to be pulsed or modulated 25. The latter information can be supplied in the form of a vector of equivalent size to the capacity vector, but with elements set to either one or zero, with a one indicating eligibility for pulsing/modulation. For example, if the first two stages in the example system described above were eligible for pulsing or modulation, an eligibility vector e could be defined as:

$$e = \begin{bmatrix} 1 \\ 1 \\ 0 \end{bmatrix}$$

The indicator 24 identifying whether the eligible stages vector 25, as defined above by the vector e, are to be pulsed or modulated could also be in the form of a simple binary flag, or in other forms apparent to those of ordinary skill in the art.

Once all system, information is available, the sequencer block 18 of the controller 10 constructs a table or matrix of stage combinations, comprising combinations of on and off states for the different individual stages. In the table or matrix, each row in the matrix relates-to one stage combination vector and contains on or off states for each stage in the multistage system. For example, for the case of three compressors of sizes 5 kW, 10 kW, and 15 kW, as described above, a stage combination vector 21 that produces 5 kW of capacity is given by:

$$a_s = [1 \quad 0 \quad 0]$$

Where the subscript s refers to the stage combination number. The capacity of any given stage combination is then the product of the stage combination vector 21 and the stage capacity vector 23, for example:

$$a_N c = 5$$

Since each element in a stage combination vector 21 is a binary value (i.e., on or off), the maximum number of stage combinations is $2^{N-1}$. The matrix of stage states 26 is constructed according to:

$$A = \begin{bmatrix} a_1 \\ \vdots \\ a_S \end{bmatrix}$$

Where $S \leqq 2^{N-1}$.

As described below, the sequencer 18 arranges selected stage combinations in the matrix according to capacity provide an ordered matrix 26. Note that, in the ordered matrix 26, the actual number of stage combination vectors for a particular system could be less than the maximum value ($2^{N-1}$) depending on the relative sizes of the stages since duplicate capacities can exist.

Referring now to FIG. 3, the procedure employed by the sequencer 18 for constructing the ordered matrix of stage states 26 is shown. In the first step 30, a stage combination counter having values ranging between 1 and $2^{N-1}$ is set to one, i.e., s=1, and the first stage combination vector is initialized to the minimum available capacity, i.e. with all of the stages in the off position. Therefore, all of the elements in the first stage combination vector are set to zero, i.e., $a_1$=[0 . . . 0].

Referring now to step 31, a decision block is entered in which a determination is made whether the user-defined (subset of) stages selected for individual control are to be subject to pulsing or modulation, i.e., this defines whether the system is wholly digital or partially analog. The decision is made based on the user-supplied input 24. If the system has modulation capability 33, the largest capacity inactive eligible stage (where eligibility is determined by the user-defined eligible states vector e 25) is selected from the current stage combination for individual control via modulation, and this stage is therefore designed as n(f). Modulation of the largest stage minimizes the total number of stage combinations at little or no loss in resolution. Otherwise in step 32, if the system is wholly digital and has only on/off stages, the individually controlled stage n(t) is always selected to be the eligible stage with the smallest capacity.

In step 34, the capacity of the stage selected for individual control in the previous step is stored in the variable $c_n$ and the stage combination counter s is incremented. Step 35 involves performing a search or binary count through all combinations in order to identify a combination that has the highest capacity but is less than or equal to the capacity of the previous stage combination plus the capacity of the individually controlled stage. For pulsed systems, if duplicate capacity combinations exist, the combination that leaves the smallest stage free for pulsing is selected. In contrast, for modulated systems, the combination that leaves the largest capacity stage free for modulation is selected when duplicate capacity combinations exist.

A decision block 36 determines if a new and eligible stage combination can be found. If the answer is yes, an additional check is performed to verify that the minimum capacity of the newly established stage combination is greater than that of the previous stage combination. If not, the stages cannot be ordered to provide contiguous control of the system and the process is ended. Otherwise, the procedure is repeated by returning to step 31. If no new and eligible stage combination is found in step 36, in step 38, all of the elements in the last stage combination vector are set to one, i.e., $a_1$=[1 . . . 1], and the procedure terminates. This last stage combination is defined so that a mapping between minimum and maximum capacity can be made to the main control signal. Since this last combination does not leave any stages inactive for individual control this combination would not be applied directly to the controlled system and only serves to define the end point of the capacity range.

As an example of the ordering process described above, consider the refrigeration example with the three compressors: 5 kW, 10 kW, and 15 kW, wherein the first two compressors (the 5 kW and 10 kW units) have been defined alternatively as eligible for pulsing or for modulation. For this example, there are two possible matrices: one for the case when the stages can be pulsed ($A_p$) and one for the case when the stages can be modulated. ($A_m$). Both these matrices are shown below.

$$A_p = \begin{bmatrix} p & 0 & 0 \\ 1 & p & 0 \\ p & 1 & 0 \\ p & 0 & 1 \\ 1 & p & 1 \\ p & 1 & 1 \\ 1 & 1 & 1 \end{bmatrix}, \quad A_m = \begin{bmatrix} 0 & m & 0 \\ m & 1 & 0 \\ 0 & m & 1 \\ m & 1 & 1 \\ 1 & 1 & 1 \end{bmatrix}$$

Where the pulsed stages are denoted by 'p' and the modulated stages by 'm'. In the pulsed system, the smallest sized inactive stage from the user-defined eligible subset of stages, is selected for pulsing as the individually controlled stage n(f). In contrast, in the modulated system the largest stage is selected as the individual controlled stage n(k) in each combination. Because of this, the pulsed matrix comprises a greater number of stage combinations than the modulated matrix.

Note that the final stage combinations in each matrix would not be implemented, as these combinations do not leave any stages inactive for pulsing or modulation. These combinations are only used to define the end points of the capacity range when mapping the control signal to required capacity. The discrete capacities available through this set of stage combinations is given by:

$$[A_p c]^T = [0\ 5\ 10\ 15\ 20\ 25\ 30]$$

$$[A_m c]^T = [0\ 10\ 15\ 25\ 30]$$

The capacities above correspond to steady state capacities for the given combinations of on and off states. Pulsing or modulating the individual stages in each combination allows intermediate capacities to be attained. The sequencer 18 could generate the appropriate stage combinations matrix 26 at initialization time and store the matrix 26 as part of a data structure or it could be generated at each sample time during real time operation 22.

Note that in the pulsed example, the capacity ranges overlap. For example, in the second combination (second row in the matrix $A_p$), the base capacity is 5 kW and individual control of the pulsed staged is able to increase this value up to 15 kW. The third combination then has a base capacity of 10 kW and can control the smallest stage to reach up to 15 kW in total capacity.

Figure 4:
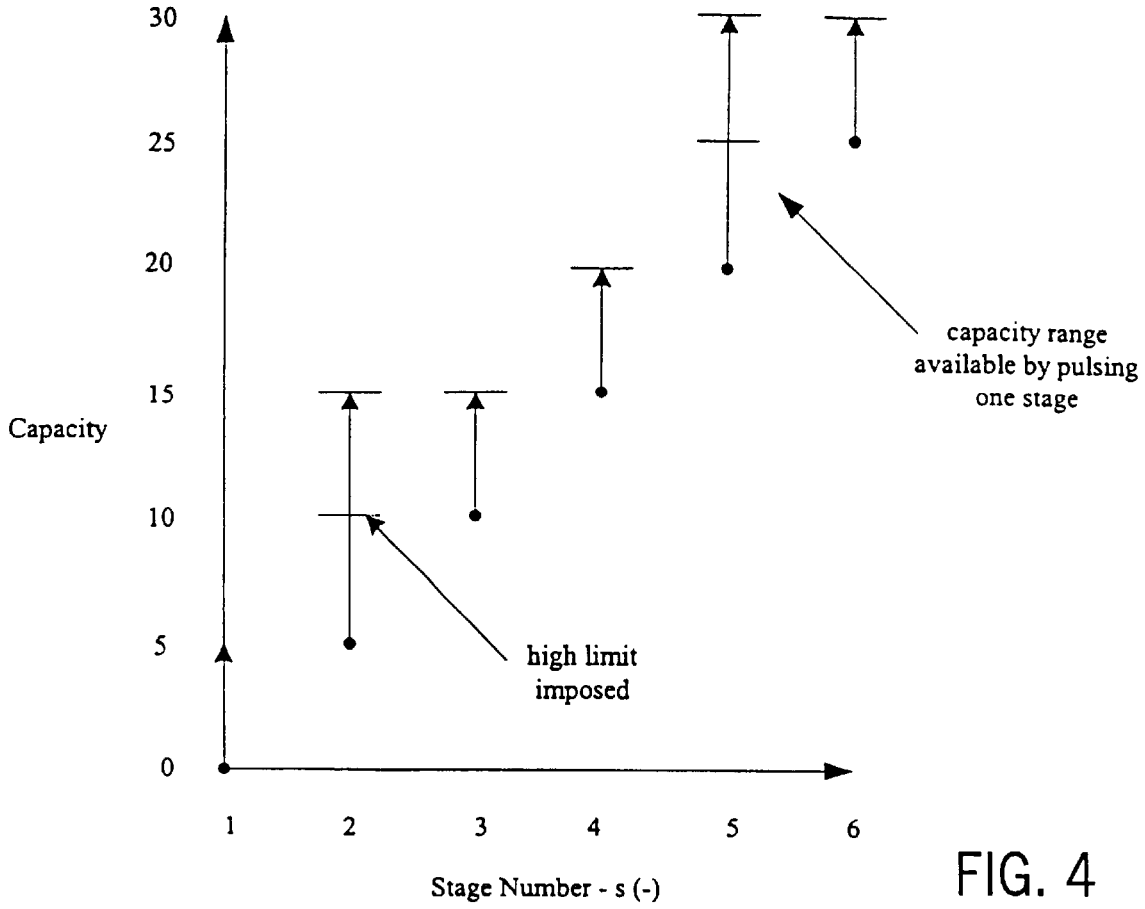
FIG. 4 is a graph illustrating the relative capacities of the stage combinations for an exemplar system constructed in accordance with the present invention.

FIG. 4 illustrates the range of capacities for the pulsed example showing the combinations where overlaps in capacity occur. The sequencer 18 deals with overlapping capacities by invoking the next stage combination at the point where an overlap begins. This approach provides a contiguous control range and optimizes control resolution by only modulating/pulsing larger sized stages over limited parts of their range thereby utilizing the smaller sized stages to the fullest extent.

Referring again to FIGS. 1 and 2, in real-time control 22, the sequencer 18 receives the main control signal u(t) from the controller 12 as an input signal. Based on this input signal, the sequencer 18 selects a stage combination b'(t) to be activated, a stage n(t) to be individually controlled, and a split range control signal v(t) to be applied to the selected modulatable or pulsable stage.

Figure 5:
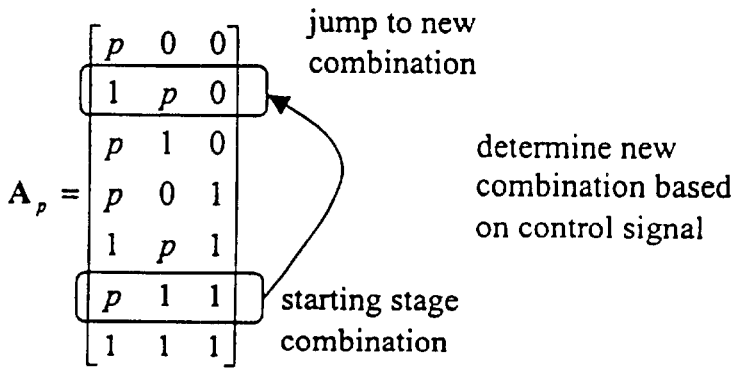
FIG. 5 is an illustration of the steps employed by the multistage system of the present invention in jumping stage combinations.

When the main control signal u(t) experiences a change and crosses a transition point and also exceeds the deadzone around a transition point, the sequencer will activate a new stage combination. If the change in the main control signal is large enough, the sequencer can provide a jump across multiple stage combinations, as shown in FIG. 5.

In the split range control method of the present invention, a new stage combination is needed when the required capacity cannot be attained with the selected stage combination b'(t) plus the additional capacity available from the stage n(t) that is being pulsed or modulated Transition points are points of potential control instability because in the vicinity of a transition point, small changes in the control signal due to effects such as momentary disturbances and noise can cause movement to a new stage combination. In turn, a change in the stage combination leads to disturbances on the control loop due to transient effects of individual stages activating and deactivating. These disturbances may then cause a change back to a previous stage combination due to the feedback controller compensating for any deviations from the setpoint r(t). "Hunting" for the appropriate stage combination in the existence of noise and other disturbances can cause unnecessary wear to the equipment and cyclical setpoint errors.

To prevent "hunting" between stages, the method of the present invention employs hysteretic deadzones defined around the transition points, wherein the size of the deadzone represents a portion of a controllable range of the devices. Generally, the main control signal u(t) is monitored and evaluated to determine which stage combination should be activated. At each point where a change in the, stage combination would occur, a deadzone is defined. The deadzone defines a region on either side of a transition point in which the stage combination is maintained in its current state. In the deadzone; the split range control signal is saturated on either its maximum or minimum value depending on whether the main control signal is increasing or decreasing.

To transition to a new stage, the main control signal must exceed the transition point plus the deadzone region that straddles these points. To determine if this is the case, the "overshoot", or the difference between the requested output capacity r(t) of the main control signal u(t) and the maximum output of the current stage is calculated and compared to the deadzone. In some applications, a second condition can be imposed. In these applications, a minimum on/off time is defined for the stages to prevent potential damage to the components of the multistage system through too rapid switching between stages.

Figure 6:
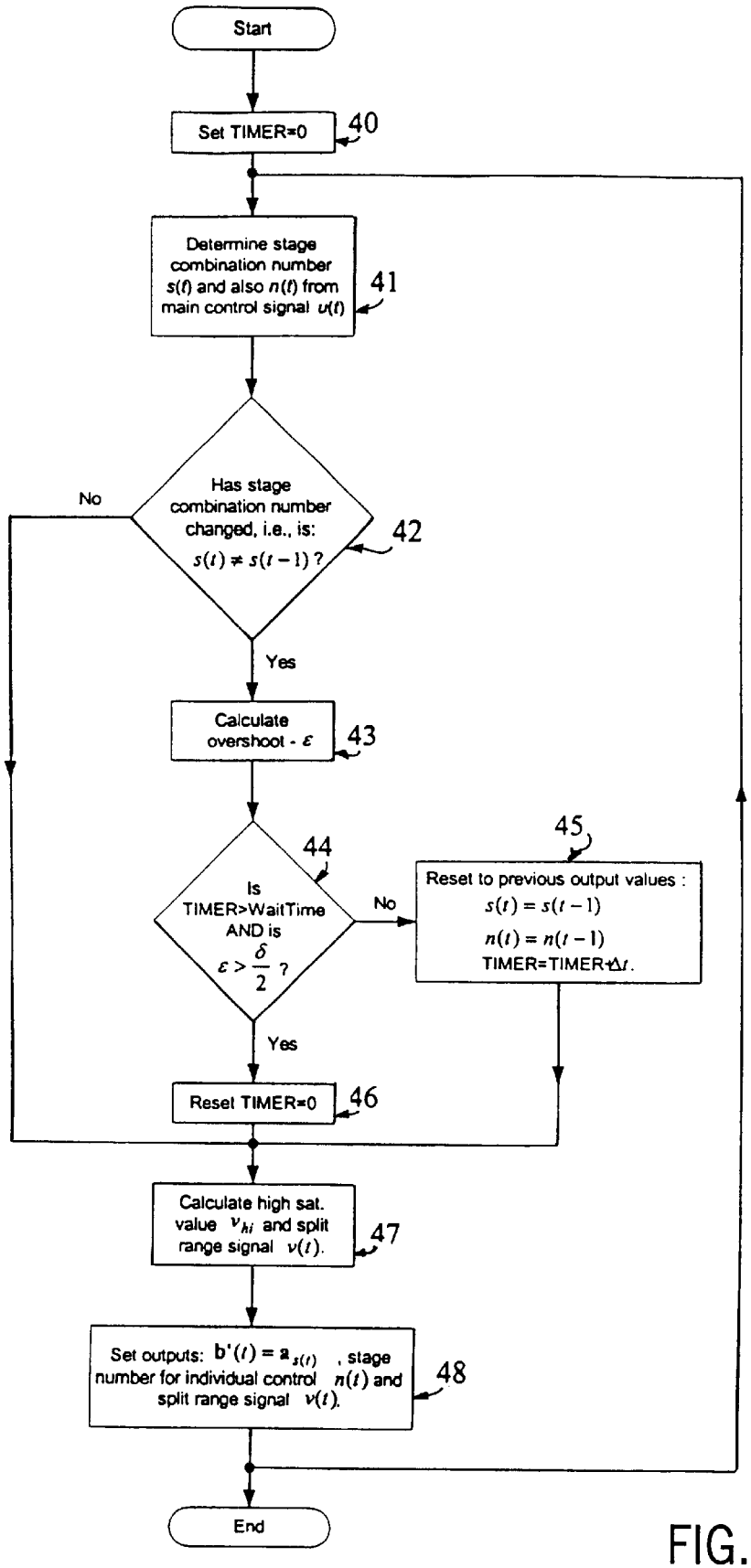
FIG. 6 is a flow chart illustrating the real time operation of the sequencer of FIG. 2.

Referring now to FIG. 6, a flow chart illustrating the steps performed by the sequencer 18 in the operational mode is shown. The real time control comprises periodically sampling the main control signal u(t) and determining an appropriate output based on the requested or setpoint value. The procedure begins in step 40 by initializing a timer variable to zero. The timer ensures that changes between, stage combinations are not made until a period denoted as "WaitTime" in the flow-chart has elapsed. The main part of the procedure begins in step 41 with the determination of an appropriate stage combination number s(t) from the main control signal. This step also identifies the stage number n(t) for the selected combination to be targeted for individual control. The stage combination is determined by first calculating the required capacity, r(t), from the main control signal u(t), which is calculated as product of the main control signal multiplied by the sum of the individual stage capacities as follows:

$$r(t) = u(t)\sum_{i=1}^{N} c_i$$

Where $0 \leqq u(t) \leqq 1$. Generally, the required capacity will lie somewhere between the capacity of two stage combinations, i.e., in the range:

$$a_l c^T \leqq r(t) \leqq a_h c^t$$

Where $a_l$ represents the stage combination with a capacity less than the required output capacity, and $a_h$ represents the stage combination with a capacity greater than the required output capacity. In step 41, the sequencer 18 selects the stage combination with the lower capacity, i.e., $_a$. The controller is able to the achieve the requested capacity r(t) by pulsing or modulating one stage in the combination, identified by n(t). As noted above, for pulsing units, the eligible stage with the smallest capacity is pulsed. For modulating units, the eligible stage with the largest capacity is selected. Also as noted above, the selected stage can be a stored value, determined in the initialization stage, and stored as part of a data structure, such as these shown above, or can be determined in real time based on stage and capacity data.

Next, in step 42, the sequencer 18 determines whether a change in the stage combination is demanded, as compared to the stage combination at the last sample time (t−1). If a new stage is demanded, step 43 determines whether the main control signal is in the deadzone. To perform this task, the "overshoot," or the amount by which the demand extends beyond a transition point into the range of a new stage combination is calculated. The overshoot (ϵ) is calculated as follows:

$$\varepsilon = \frac{q_k - a_{s_{k-1}+1} c^T}{c_{\min}}, \quad \text{for } s_k > s_{k-1}$$

-continued $$\varepsilon = \frac{a_{s_{k-1}} c^T - q_k}{c_{\min}}, \quad \text{for } s_k < s_{k-1}$$

Here, the denominator provides normalization to the controllable range of smallest stage so that the deadzone is always of equal size in terms of the main control signal. A decision is made in step 44 as to whether the overshoot exceeds the size of the deadzone divided by two, i.e., is the following condition satisfied?

$$\epsilon \geqq \delta/2$$

Where β is a predefined dead zone parameter that can be hardwired into the control unit or selected through user input, as described below. Note that the deadzone is divided by two because it straddles each transition point and in moving beyond a transition point only one half of the deadzone need be considered. Step 44 also checks whether the last stage combination has been held for a minimum time period as specified by WaitTime. If the overshoot does not exceed the deadzone and the minimum wait time has not elapsed in step 45, the selected stage combination number s(t) and the individually controlled stage number n(t) are reset to their previous values. If the deadzone has been exceeded and the minimum time has elapsed, the timer is set back to zero in step 46.

Step 47 involves calculating the split range control signal v(t) from the requested capacity r(t). In order to make this calculation, a high limit is calculated. The high limit is usually one except in the cases where there is an overlap between capacities, as was the case in the refrigeration example illustrated above (e.g., in moving from stage 2 to 3). The high limit is calculated from:

$$v_{hi}(t) = \frac{a_{s(t)+1} c^T - a_{s(t)} c^T}{c_{n(t)}} \tag{1}$$

Where n(t) is the stage number that is to be pulsed or modulated and division by the capacity $c_{n(t)}$ normalizes the value in the range 0-1. In step 47, the split range control signal v(t), representing the fractional amount of capacity that must be provided by the pulsed or modulated stage to obtain the requested capacity, is calculated based on any remaining capacity that is unable to be met by the lower stage combination as follows:

$$v(t) = \left(r(t) - a_{s(t)} c - c_{\min} \frac{\delta}{2}\right) \frac{v_{hi}(t)}{a_{s(t)+1} c^T - a_{s(t)} c^T - \delta c_{\min}}$$

Where $0 \leqq v(t) \leqq V_{hi}(t)$ is the split range control signal, which is constrained within the range 0 to $V_{hi}(t)$. Note that application of these limits cause the split range control signal to saturate on the upper or minimum bound when the demanded capacity r(t) is within the deadzones.

Figure 7:
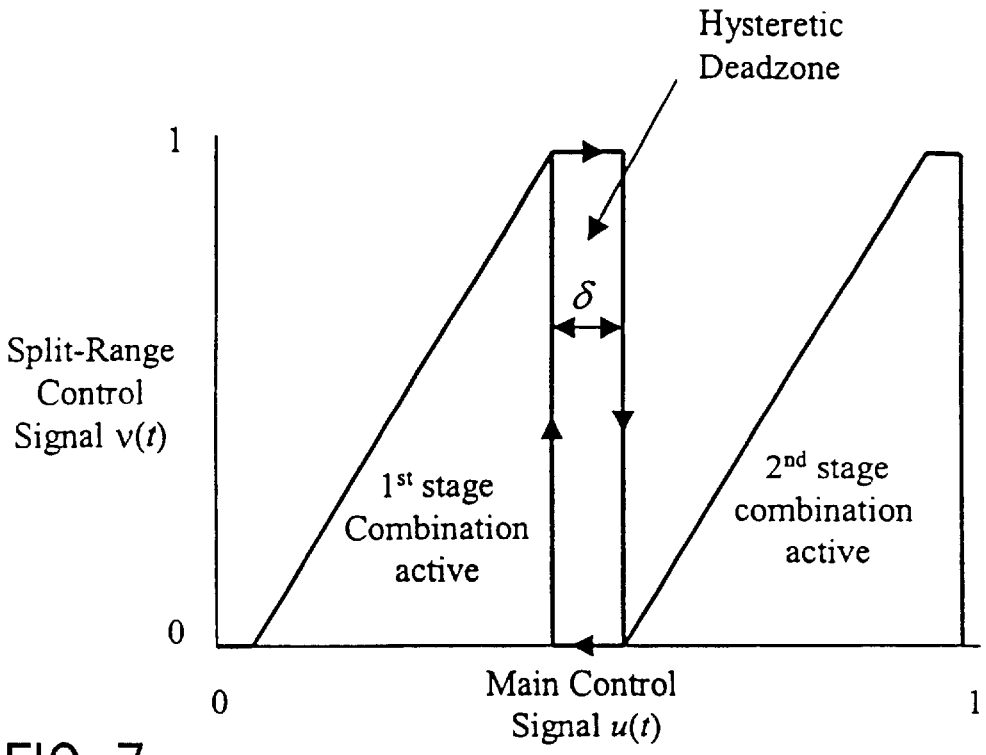
FIG. 7 is a graphical illustration of the operation of a main control signal in accordance with the present invention.

Finally, in step 48, the selected stage combination from the matrix shown as $a_{s(t)}$ in the flow chart is prepared for output by mapping it onto the output vector b'(t). The stage number n(t) and the split range signal are also output in step 48. The procedure repeats itself by returning to step 41. Application of the above procedure results in a hysteretic deadzone as shown in FIG. 7. This type of deadzone is known to those of skill in the art.

The behavior of the main control signal u(t) is determined by the feedback controller 12 and disturbances acting on the control loop. The time it takes for the main control signal u(t) to change by an amount large enough to cross a transition point and associated deadzone is dependent on the behavior of the main control signal u(t) and the size of the deadzones. In order to simplify estimation of the deadzones, assumptions can be made as to how the controller is tuned so that the size of the deadzone can be related directly to general specifications of control performance.

When the controller 12 is a PI controller, as described above, the deadzone δ can be calculated as a function of acceptable setpoint error, acceptable time delay, and the dead time and time constant of the process, as defined below. Because the dead time and time constant generally fall into a predetermined range for HVAC systems, a preselected deadzone can be applied across a range of systems with scalable results.

Figure 8:
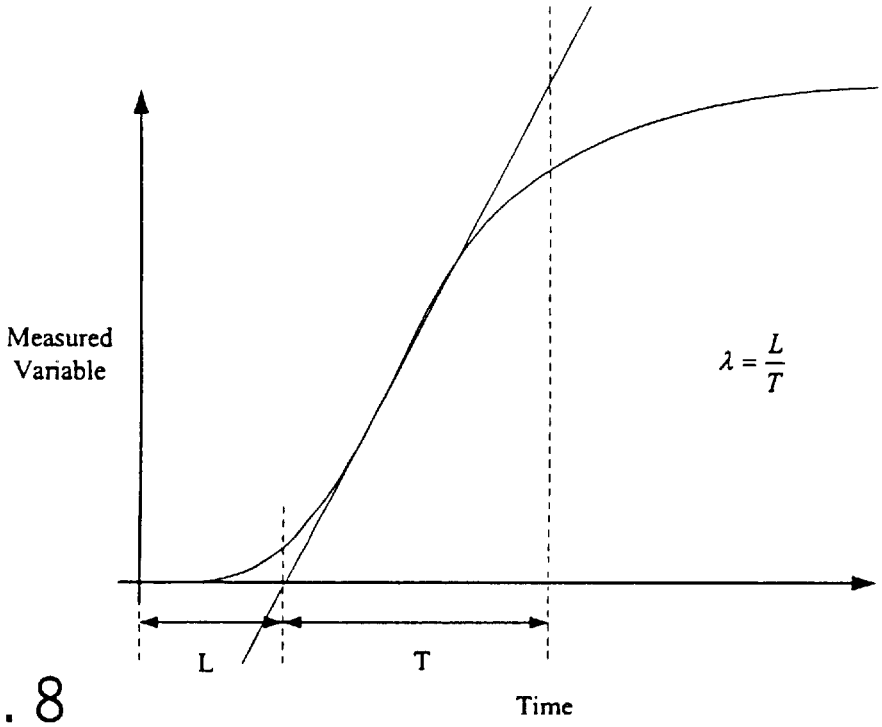
FIG. 8 is a graph illustrating a curve of the change in output versus time for a multistage system including the system dead time L and the time constant of the process T.

Referring now to FIG. 8, for a PI controller, two constants can be used to define the response of the system. The system dead time L defines the time elapsed between the times when the system receives a signal indicating that a change is to be made, and when the system begins to respond. The time constant of the process T is a measure of the speed of response of the system, i.e. the slope of a curve comprising the change in output versus time.

Applying these variables to standard control theory equations, the following equation can be derived:

$$T_s = \frac{10\delta\lambda^2}{3\alpha} - 3\lambda$$

Here, $T_s$ is the time:required for a change in main control signal to be large enough to induce transgression across a deadzone for a sudden large disturbance (e.g., a step change in setpoint). $T_s$ is given as a multiple of the time constant T such that:

$$\Delta t = T_s T$$

Where Δt is the actual time delay. The normalized error a is a fraction of the gain of the smallest stage in the considered multistage system, and λ is defined as the dead time L divided by the time constant T of the system, where T and L are defined as shown in FIG. 8. Therefore, T and L are defined constants, dependent upon the system used. Variables $T_s$ and α are user defined variables, which can be selected based on the amount of error and response time tolerable in the system control. The deadzone δ, therefore, is defined as a function of the system parameters T and L and the selected variables $T_s$ and α:

$$\delta = \frac{3\alpha T_s + 9\alpha\lambda}{10\lambda^2}$$

In HVAC&R applications, λ is typically on the order of 0.4. It is most likely that performance be specified in terms of the maximum time period (as a multiple of system time constant) over which an error given in terms of a fraction of the gain of one stage could be tolerated. For example, if an error equivalent to 10% the gain of one stage could be tolerated for a period equal to the system time constant and λ was 0.4, the deadzone parameter would be 41.25%.

The issue of deciding what a value to select depends on the required control performance. Since errors are expressed as fractions of the gain of one stage and saturation time delays are a multiple of the system time constant, the control performance is scalable across different gains and time constants. The only limitation is that the PI controller needs to be properly tuned for the controlled system so as to provide the desired normalizing effect and make the expression for a above valid.

Figure 9:
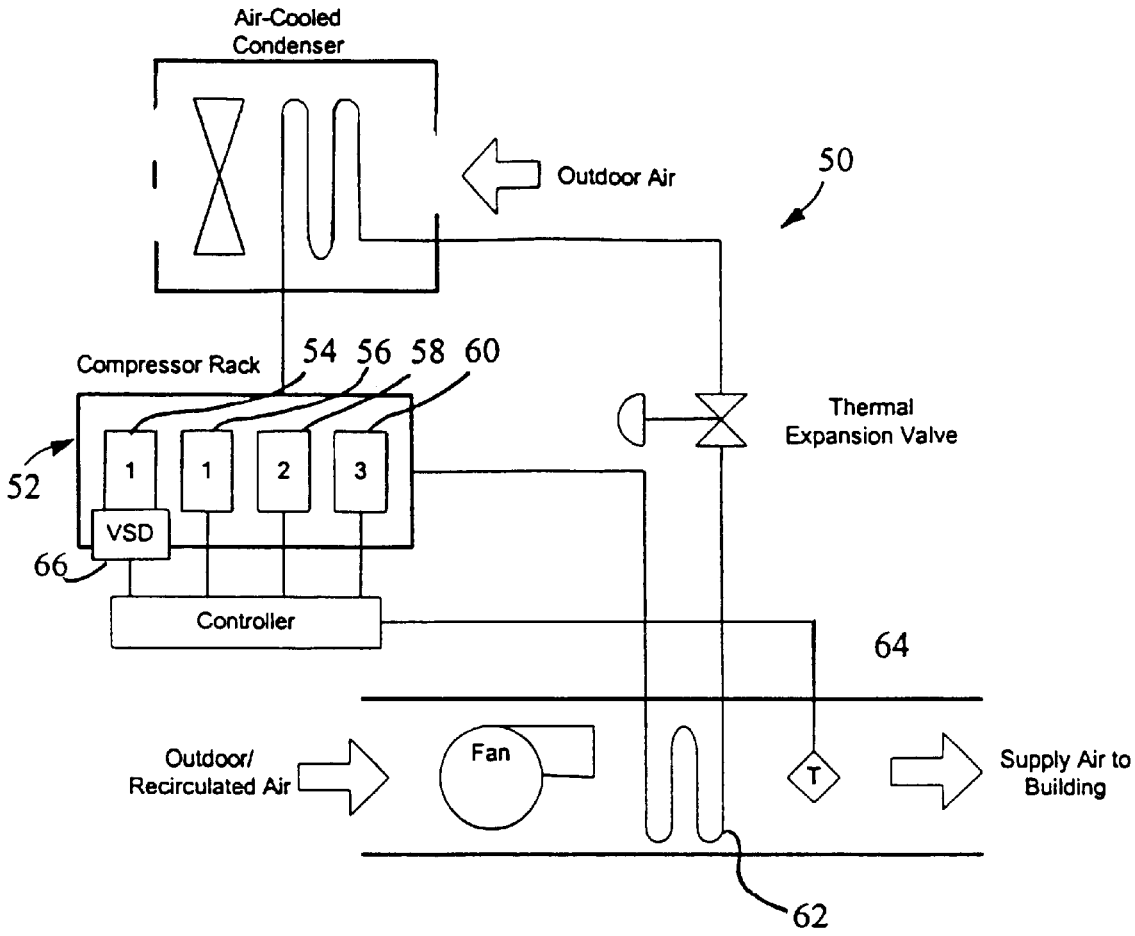
FIG. 9 is an illustration of an exemplary multistage system employed in comparative testing of the present invention.

Referring now to FIG. 9, a simulated HVAC system 50 that is used to demonstrate the behavior of the present invention is shown. The simulation contains models of a compressor rack 52 comprising four separate compressors 54, 56, 58 and 60, therefore providing a size vector 19 with the following (relative) capacities:

$$c^T = [1 \quad 1 \quad 2 \quad 3]$$

The smallest stage is capable of being modulated, while all other stages are only able to be on or off. The four compressors generate cooling capacity for a DX coil 62 that is immersed within a ducted air-stream that could serve a building or space, as illustrated in the diagram.

The control objective, is to regulate the temperatures of the air leaving the DX coil 62 to a setpoint by modulating the smallest compressor 52 via a variable speed drive (VSD) 66 and by activatingg or deactivating the other stages when necessary. The compressors and associated refrigeration cycle are modeled in an idealized fashion and NTU-effectiveness equations (e.g., Clark, 1985) are used for the coil that is immersed in the ducted air stream.

The simulated system was developed in the MATLAB/Simulink environment. The simulation was sized so that an incoming air stream of 24° C. could be cooled down to 9.7° C. when all compressors 54, 56, 58 and 60 were on, and the airflow across the coil 62 was at a predetermined design value. Dynamic behavior was reproduced in the simulation using a first-order plus dead-time model, which has been shown to be an effective characterization of a wide range of HVAC&R and systems. The overall time constant for the system was set to 2-minutes 30-seconds and the dead time was set to one minute. These, values are realistic for rooftop DX systems of the type considered.

The simulated system was used to test control algorithms provided by the prior art time delay approach and the approach of the present invention. In these tests, inlet air temperature and flow rate to the DX coil are maintained at a constant level while setpoint changes are applied. Step changes and ramp changes were applied to the setpoint in order to exercise the system across a range of multiple stage combinations. Setpoint values were selected so that the system would be operated close to stage transition points. Uniformly distributed noise was added to the controlled variable with an amplitude of 0.28° C. The noise was limited to frequencies above 0.0167 Hz in order to mimic the effect of having an analog low-pass filter implemented in the control system.

1. Tests using prior art time delay approach. The time delay approach was implemented by first using the algorithm in the present invention to generate a matrix of stage states:

$$A = \begin{bmatrix} 0 & 0 & 0 & 0 \\ 0 & 1 & 0 & 0 \\ 0 & 0 & 1 & 0 \\ 0 & 1 & 1 & 0 \\ 0 & 1 & 0 & 1 \\ 0 & 0 & 1 & 1 \\ 0 & 1 & 1 & 1 \end{bmatrix}$$

Note that generation of such a table would normally need to be carried out manually in the prior art method;. The first stage in each combination (stage combinations correspond to rows in the A matrix) was selected for modulation. A PI controller was applied to this first stage in order to control the supply air temperature to the given setpoint. Since the PI controller only controlled one stage and not all stages, the controller was tuned based on the gain of one stage: 14.3*1/7=2.04° C. The PI controller incorporated a feature that monitored the time period over which the control signal was saturated at its minimum or maximum value, 0% and 100% respectively. When high limit saturation was detected, a new stage combination was invoked from the table that corresponded to the next greatest capacity. Similarly, low saturation would lead to selection of the next smallest capacity from the combinations in the table. Since the table was ordered according to capacity, the method would step sequentially through the combinations until modulation of the one stage could meet the setpoint. Tests were carried out using a range of time delay values.

2. Test using the sequencer controller of the present invention. In this test, the control method as described in the paper was implemented and evaluated. Results were generated for a range of deadzone parameter values (δ).

The performance of each method was characterized using two performance indices: mean absolute error (MAE), and number of stage state changes. The MAE provides a measure of control performance in terms of how well the methods are able to track setpoint. The number of changes is a measure of wear on the system. Ideally, both the MAE and the number of changes should be minimized. However, there is a trade-off between these two performance measures and the desired relative importance weightings may vary for different applications. Test results are presented in the following sections.

Table 1 shows the results from using the time delay method across a range of transition time delay values. The number of stage changes decreases as the time delay increases. Conversely, the MAE increases with the time delay. There is therefore a direct trade-off between control performance and wear with this method.

TABLE 1

Results of tests with time delay approach

| Tunable Parameter - delay time (secs) | Number of Stage Changes | MAE (° C.) |
|---|---|---|
| 2 | 168 | 0.67 |
| 5 | 150 | 0.68 |
| 10 | 96 | 0.70 |
| 20 | 72 | 0.74 |
| 50 | 48 | 0.86 |
| 100 | 18 | 1.02 |
| 150 | 14 | 1.10 |
| 300 | 10 | 1.50 |
| 600 | 7 | 2.46 |

Figure 10:
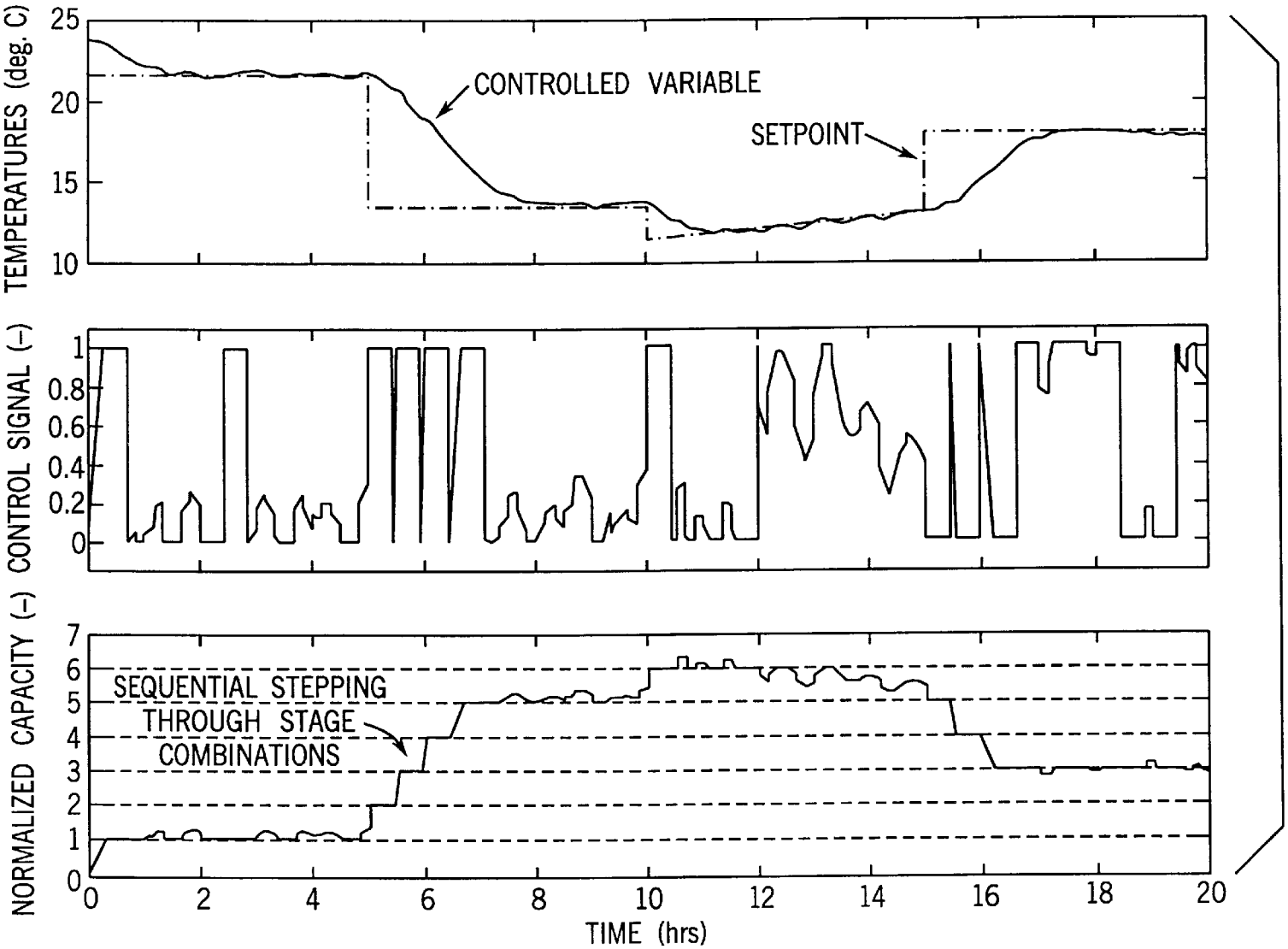
FIG. 10 is an illustration of results of a first test of a system constructed in accordance with FIG. 9 controlled in accordance with the present invention wherein the time delay set equal to the system time constant (150 secs).

FIG. 10 results from one of the tests where the time delay was set equal to the system time constant (150 secs). The top graph in the FIG. 12 shows the setpoint and controlled variable. The second graph shows the control signal being used to modulate the smallest sized compressor and the lower graph shows the delivered capacity. The point at which new stage combinations are invoked are shown as dashed horizontal lines in the lower graph, i.e., increments of one in the normalized capacity range. The figure shows that the method is sluggish in responding to the large setpoint changes due to the fact that the method has to step through all intermediate stage combinations to reach a new load point. However, the method controls more aggresively when the operation is within the range of one stage, e.g., during the ramp change in setpoint. The method eliminates most of the noise effect with the transition delay time set to 150 secs. However there are times during the first and last setpoint periods where the noise does still cause transgression across the transition points, e.g., 2-4 hrs and 17-20 hrs.

Table 2 shows the test results from using the new algorithm of the present invention for a range of different deadzone sizes. The table shows that the MAE increases with deadzone size and the number of changes decreases. The MAE values are slightly higher than those in the simple deadzone results, but significantly lower than those in the time delay results. The number of stage combination changes is also an improvement over the previous method for comparable levels of MAE.

TABLE 2

Results of tests using the new sequencer algorithm

| Deadzone - % | Number of Stage Changes | MAE - ° C. |
|---|---|---|
| 0 | 46 | 0.52 |
| 10 | 32 | 0.53 |
| 20 | 13 | 0.55 |
| 30 | 11 | 0.54 |
| 40 | 8 | 0.53 |
| 50 | 7 | 0.55 |
| 60 | 7 | 0.61 |
| 70 | 6 | 0.76 |
| 80 | 6 | 0.97 |
| 90 | 7 | 1.80 |

Figure 11:
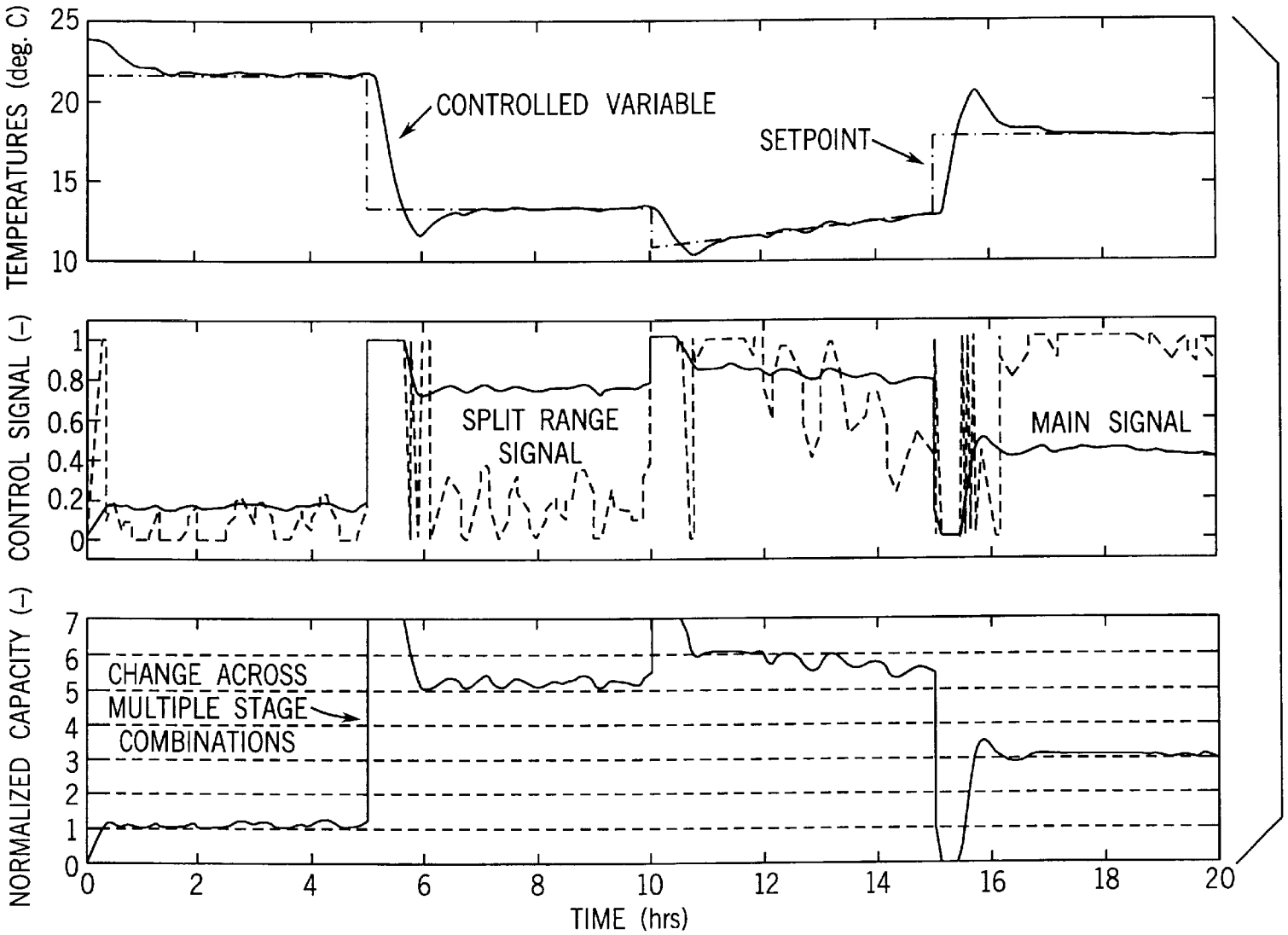
FIG. 11 is an illustration of results of a first test of a system constructed in accordance with FIG. 9 controlled in accordance with the present invention wherein the deadzone set at twenty percent.

FIG. 11 shows test results with the deadzone set at 20%, i.e., δ=0.2. It can be observed that control is stable at the transition points. It is interesting to note that the number of changes made when testing a standard split range method with no deadzone or transition point provision when there was no noise in the system was 18. Thus, the results in Table 2 imply that the deadzone method was able to eliminate all of the noise effect at a deadzone value of 20%.

The significance of the 20% deadzone level can be explained by the fact that this corresponds to the level at which the method would be expected to eliminate the noise that was added to the process. Recall that noise was applied with a maximum frequencey of 1/60. Since the system time constant was 150 secs, an error at the maximum magnitude of the noise might therefore be sustained for a. period of 60/150=0.4 times the time constant. The noise amplitude as a fraction of the gain of one stage is 0.28/2=0.14 and the largest error due to the noise would thus be +/−0.07. Equation 1 can now be used to estimate the deadzone size that would be required to eliminate this noise. Setting $T_s$ to 0.4 and α to 0.07 in the equation yields a deadzone value approximately equal to 20%. This therefore validates the approach that was presented for relating control performance to the deadzone size. The test results show that the new algorithm improves control performance and reduces system wear over a common prior are method.

Although a specific embodiment has been shown and described, it will be apparent to one of ordinary skill in the art that a number of changes and modifications can be made within the scope of the invention. For example, although a specific method for automatically establishing and ordering stages and stage combinations has been described, it will be apparent to those of ordinary skill in the art that there are a number of ways of effecting similar results, and that variations in the processing can be made-within the scope of the invention. Furthermore, various novel aspects of the invention can be applied separately. For example, automatic ordering of the stages and stage combinations can be applied in a number of applications. Additionally, the split range and hysteretic control method can be applied regardless of whether the stages and stage combinations have been automatically ordered and sequenced as described above. It will also be apparent to those of ordinary skill in the art that a number of different types of controllers, software systems, control devices or stages devices can be employed in the system of the present invention. Likewise, a number of different feedback control systems can be employed as the first stage in the system and various switching law procedures can be applied to pulse systems.

It should be understood, therefore, that the methods and apparatuses described above are only exemplary and do not limit the scope of the invention, and that various modifications could be made by those skilled in the art that would fall under the scope of the invention. To appraise the public of the scope of this invention, the following claims are made:

We claim:

1. A method for controlling a multistage control system and for providing transitions between stage combinations, wherein the multistage system comprises a plurality of stages, each of the stages has a defined capacity, and at least one of the stages is individually controllable via pulsing or modulation, the method comprising the following steps:

ordering a plurality of stage combinations in order of capacity, each stage combination including a stage which can be individually controlled to provide a requested capacity between successive stage combinations;

determining a plurality of transition points, the transition points being defined as a capacity level at which a change in stage combination is required to provide a requested capacity;

defining a deadzone around each transition point;

receiving a main control signal, and using the main control signal to determine a stage combination to provide a requested output capacity;

selecting a new stage combination when the main control signal exceeds the transition point plus the deadzone;

maintaining the current stage combination and saturating a modulatable stage when the main control signal is in a deadzone.

2. The method as defined in claim 1, further comprising the steps of evaluating an acceptable error level and an acceptable delay time, and using the acceptable error and the acceptable delay time to calculate the deadzone.

3. The method as defined in claim 1, further comprising the steps of providing a PI control loop, the PI control loop receiving a command and an error signal and providing the main control signal to the multistage controller.

4. The method as defined in claim 1, wherein the step of ordering a plurality of stage combinations is performed automatically by a processor in the multistage system.

5. A method for automatically ordering a plurality of stages in a multistage control system to provide contiguous capacity control between a minimum and a maximum level, the method comprising the following steps:

determining the capacity of each of the plurality of stages;

determining which of the plurality of stages are individually controllable;

establishing a first stage combination, wherein all stages are off and an individually controllable stage is designated for modulation; and selecting each successive stage combination to have a minimum capacity equivalent to or less than the maximum capacity of the previous stage combination and to have an individually controllable stage to provide contiguous capacity to the minimum capacity of the next successive stage.

6. The method as defined in claim 5, further comprising the step of determining whether the multistage system includes modulatable stages or only pulsable stages.

7. The method as defined in claim 6 further comprising the step of selecting the individually controllable stage having the smallest capacity as the first stage combination when the multistage system includes pulsable stages.

8. The method as defined in claim 6 further comprising the step of selecting the individually controllable stage having the largest capacity as the first stage combination for a multistage system comprising thodulatable stages.

9. The method as defined in claim 5, wherein the step of determining the capacity of each of the plurality of stages comprises receiving input data identifying the capacity of each of the stages from a user.

10. The method as defined in claim 5, further comprising the step of determining which of the plurality of stages are individually controllable comprises receiving input data identifying the capacities of each of the stages from a user.

11. The method as defined in claim 5, wherein the step of selecting successive stage combinations further comprises comparing each possible stage combination.

12. A method for controlling a multistage system comprising a plurality of stages, wherein each of the stages has a defined capacity, and at least one of the stages is individually controllable via pulsing or modulation, the method comprising the following steps:

obtaining input data from a user indicating the number, type and capacity of each stage in a multistage system;

automatically ordering a matrix of stage combinations from a first stage combination providing a minimum capacity to a last stage combination providing a maximum capacity, each stage combination having at least one inactive stage that is individually controlled to provide contiguous capacity output control between successive stages;

periodically monitoring an input main control signal;

calculating a requested output capacity based on the input main control signal;

determining a stage combination selected to provide the selected output;

compare the stage combination to a previous stage combination, and if the stage combination is not equivalent to the previous stage combination, determining whether the requested output capacity exceeds a predetermined deadzone; and if the deadzone has not been exceeded, saturating the output of the previous stage;

if the deadzone is exceeded, switching to the selected stage and calculating a split range control signal for controlling the selected stage to provide the selected output capacity.

13. The method as defined in claim 12, further comprising the step of monitoring an elapsed time, comparing the elapsed time to a predetermined minimum time period, and preventing the step of switching to the selected stage combination until the elapsed time exceeds the predetermined value.

14. The method as defined in claim 12, further comprising the steps of determining when the capacity of a first stage combination and the capacity of a second stage combination overlap, calculating a high saturation value, the high saturation value being the value at which a transition point between the first and second stage combinations will occur.

15. The method as defined in claim 12, wherein the step of ordering a stage matrix of capacities further comprises the steps of determining whether the stages are analog or digital, selecting the stage with the smallest capacity for pulsing when the stage is digital, and selecting the stage with the largest capacity when the stage is analog.

16. The method as defined in claim 1, further comprising the steps of evaluating an acceptable error tolerance and an acceptable time delay tolerance, and determining the deadzone based on the error tolerance and the time delay tolerance.

17. The method as defined in claim 1, further comprising the calculating the split range control to factor in the deadzone.

18. A multistage system comprising:

a plurality of stages for controlling an HVAC system, the plurality of stages including at least one individually controllable stage;

a programmable controller, the programmable controller being coupled to each of the stages, the programmable controller being programmed to:

receive a setpoint;

determine which of the stages should be activated based on the requested setpoint;

calculate a split range signal, the split range signal being used to command the one individually controllable stage to provide the requested output;

determine whether the main control signal is in a predefined deadzone and saturating the split range signal if the main control signal is in the deadzone.

19. The multistage system as defined in claim 18, wherein the programmable device is a programmable logic controller.

20. The multistage system as defined in claim 18, wherein the at least one individually controllable stage is an analog device.

21. The multistage system as defined in claim 18, wherein the at least one individually controllable stage is a digital device, and the split range signal is employed to provide pulse width modulation of the digital device.

* * * * *

UNITED STATES PATENT AND TRADEMARK OFFICE

CERTIFICATE OF CORRECTION

PATENT NO. : 6,540,148 B1
DATED : April 1, 2003
INVENTOR(S) : Salsbury et al.

It is certified that error appears in the above-identified patent and that said Letters Patent is hereby corrected as shown below:

Column 18,
Line 17, replace “thodulatable” with -- modulatable --.

Signed and Sealed this

First Day of July, 2003

JAMES E. ROGAN
*Director of the United States Patent and Trademark Office*